United States Patent [19]

Booms et al.

[11] 4,420,556

[45] Dec. 13, 1983

[54] PHOTOGRAPHIC SILVER HALIDE MATERIALS

[75] Inventors: Robert E. Booms, Rochester, N.Y.; Colin Holstead, Hertfordshire, England

[73] Assignee: Eastman Kodak Company, Rochester, N.Y.

[21] Appl. No.: 300,713

[22] Filed: Sep. 10, 1981

[30] Foreign Application Priority Data

Sep. 11, 1980 [GB] United Kingdom ..... 8029467

[51] Int. Cl.[3] ..... G03C 1/40

[52] U.S. Cl. ..... 430/549; 430/941; 430/553; 430/557; 430/555; 430/558; 430/226

[58] Field of Search ..... 430/549, 941, 553, 557, 430/555, 558, 226

[56] References Cited

U.S. PATENT DOCUMENTS

| | | | |
|---|---|---|---|
| 3,227,550 | 1/1966 | Whitmore et al. | 430/226 |
| 3,330,655 | 7/1967 | Salminen | 430/226 |
| 3,647,436 | 3/1972 | Bush | 430/226 |
| 4,206,279 | 6/1980 | Campbell et al. | 430/941 |
| 4,221,860 | 9/1980 | Hirose et al. | 430/549 |

*Primary Examiner*—Won H. Louie, Jr.
*Attorney, Agent, or Firm*—Harold E. Cole

[57] ABSTRACT

Granularity of silver halide photographic materials is reduced by employing a coupler which yields a dye of such mobility that controlled image smearing occurs.

14 Claims, 8 Drawing Figures

PHOTOGRAPHIC SILVER HALIDE MATERIALS

Figure 1:
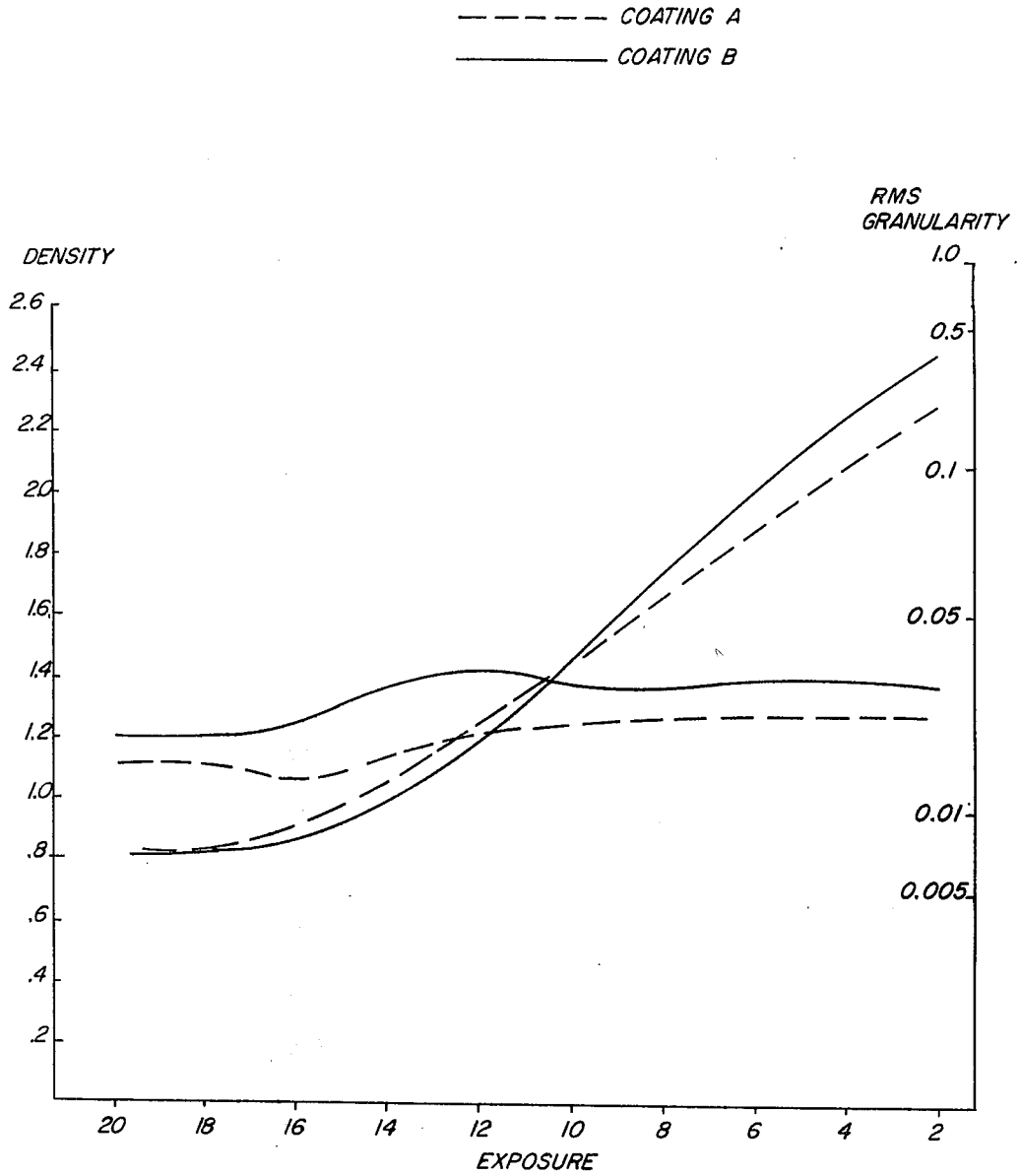

This invention relates to photographic photosensitive silver halide materials, in particular to such materials having reduced granularity.

Photographic silver halide materials containing incorporated color couplers have been known for many years. The couplers and the image dyes produced therefrom contain ballasting groups of such molecular size and configuration that they are rendered nondiffusible in the element as coated, and during and subsequent to processing. Such photographic materials are processed by steps which include color coupling development to produce both a silver image and a dye image and subsequent bleaching of the silver to leave the dye image alone.

As these materials are made with increasing photographic speed, larger silver halide grains are used. This results in an increase in the granularity of the dye image, other things being equal.

We have now discovered that if at least some of the image dye produced is allowed to diffuse to a limited extent, neighboring clouds of image dye are smeared into each other leading to reduced image granularity.

According to the present invention there is provided a silver halide photographic element comprising at least one silver halide emulsion layer and nondiffusible dye-forming couplers associated with the layer or layers, wherein the nondiffusible dye-forming couplers comprise a first nondiffusible dye-forming coupler which, upon reaction with oxidized color developing agent, yields a nondiffusible dye and a second nondiffusible dye-forming coupler which, upon reaction with oxidized color developing agent, yields a dye of such mobility that controlled image smearing occurs.

Where the elements of this invention contain only one silver halide emulsion layer, that layer has associated therewith each of the first and second couplers. Where the elements of this invention contain more than one silver halide emulsion layer, the first coupler is associated with at least one of the layers and the second coupler is associated with at least one other of the emulsion layers.

With the present materials neighboring clouds of image dye are smeared into each other, and it is this effect which leads to reduced granularity. With multicolor photographic materials the reduction in granularity can be effected in any of the dye image-forming units. When the dye image forming units are comprised of more than one layer sensitive to each primary region of the visible spectrum, the reduction in granularity can be effected in each of the layers or in only one of the layers, preferably the faster emulsion layer. Similarly the reduction in granularity can be effected in layers sensitive to each of the primary regions of the visible spectrum or in only one or two such layers.

Since the reduction in granularity in a given layer may lead to a decrease in sharpness of the image formed in that layer, it is preferred that the layer or layers in which granularity is reduced in accordance with this invention be those which yield a dye to which the eye is less sensitive, such as a yellow dye forming layer. Further, because the layer closest to the source of exposing radiation has the least amount of optical degradation (i.e., loss in sharpness) due to exposure, it is the layer in which the reduction in granularity in accordance with this invention preferably is effected. This layer usually is a yellow dye forming layer. The amount of silver usually employed in the layer in which image smearing occurs can be reduced, while still achieving acceptable granularity, thus allowing a thinner emulsion layer and hence increased sharpness in underlying layers.

As will be apparent to the photographic chemist, the properties of the components of the present photogtaphic materials and the intended method of processing will be chosen so that the increase in image dye mobility leading to the desired reduction in granularity is balanced against the loss in sharpness which would occur if the image dye were allowed to diffuse over too great a distance.

Controlled image smearing in accordance with this invention can be achieved in a number of ways. In a first embodiment, the coupler which provides controlled image smearing is one which yields a dye which is slightly mobile so that the desired degree of image smearing has taken place by the time processing and drying is completed. In a second embodiment the coupler which provides controlled image smearing is one which yields a dye which is diffusible, and a mordant for the dye is associated with the layer containing that coupler. In the embodiments where the element contains more than one silver halide emulsion layer, the coupler which provides controlled image smearing can be the only dye-forming coupler in the layer or other dye-forming couplers, such as couplers which yield nondiffusible dyes, can be present in the layer in amounts up to 99 percent by weight of the total dye forming couplers in the layer. The greater the proportion of coupler which provides controlled image smearing relative to other dye-forming couplers in the layer, the greater the amount of image smearing which occurs.

The couplers employed in each of the embodiments have, in the coupling position, a ballast group which renders the coupler immobile. Upon coupling with oxidized color developing agent the ballast group is detached, so that the dye formed is no longer immobilized and is thus able to diffuse in the layer to smear the image. Couplers employed in the first embodiment have, in a non-coupling position, a secondary ballast group which gives the dye the desired slight mobility. Couplers employed in the second embodiment have, in a non-coupling position, a solubilizing substituent which renders the dye diffusible so that it can diffuse to and be immobilized by the mordant.

Couplers employed in the first embodiment can be represented by the structure:

```
COUP—SECONDARY BALLAST
*
|
MAIN BALLAST
```

wherein:

COUP is a dye-forming coupler moiety, the asterisk (*) denoting the coupling position thereof;

MAIN BALLAST is a group, attached to the coupling position of COUP and detachable therefrom by means of reaction of COUP with oxidized color developing agent, which is of such size and configuration as to render the coupler nondiffusible; and SECONDARY BALLAST is a group, attached to a noncoupling position of COUP, which is of such size and configuration that the dye formed by coupling of COUP with oxidized color developing agent is slightly mobile.

The coupler moiety represented by COUP can be any coupler moiety known or used in the art to form a colored reaction product with oxidized color developing agent. Common yellow dye-forming couplers are acylacetanilides such as acetoacetanilides and benzoylacetanilides; common magenta dye-forming couplers are pyrazolones, pyrazolotriazoles, pyrazolobenzimidazoles and indazolones; and common cyan dye-forming couplers are phenols and naphthols. These couplers can form the coupler moiety COUP.

The main ballast group, as indicated, is a group of such molecular size and configuration as to render the coupler nondiffusible. The specific nature of the main ballast group is not critical, so long as it confers nondiffusibility on the coupler. Useful main ballast groups include alkyl groups and aryl groups having from 8 to 32 carbon atoms. These groups can be unsubstituted or substituted with groups which enhance the nondiffusibility of the coupler, modify the reactivity of the coupler or enhance the diffusibility of the ballast group after it is detached from the coupler. The main ballast group contains a linking group through which it is joined to the coupling position of the coupler moiety. Representative linking groups include oxy (—O—), thio (—S—), and azo (—N=N—). Preferred main ballast groups are alkoxy, aryloxy, alkylthio and arylthio groups containing from 8 to 32 carbon atoms.

The secondary ballast group is a group of moderate size and bulk so as to render the dye slightly mobile. As will be appreciated the specific secondary ballast group will depend upon the particular coupler moiety employed, the nature of other substituents thereon, the particular color developing agent which couples with the coupler to form dye and the nature of substituents thereon. The specific secondary ballast group employed is not critical so long as it confers upon the dye the desired degree of mobility. Useful secondary ballast groups can be selected from alkyl groups of 4 to 20 carbon atoms and aryl groups of 6 to 20 carbon atoms. These groups can be unsubstituted or substituted with groups which modify the spectral absorption characteristics of the dye or its diffusibility. For example, the secondary ballast group can contain base ionizable groups, such as hydroxy groups, carboxylic acid groups, sulfonic acid groups, and aminosulfonyl groups and ionizable salts thereof to render slightly mobile an otherwise immobile dye. The secondary ballast group can contain a linking group through which it is joined to the coupler moiety. Representative linking groups include oxy, thio, carbonyl, carboxyl, amino, carbamoyl, aminocarbonyl, ureido, sulfamoyl and aminosulfonyl.

Preferred yellow couplers useful in this first embodiment can be represented by the formula:

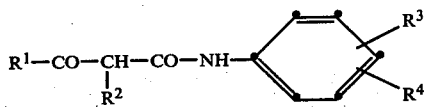

II wherein:

$R^1$ is an aryl group, e.g., phenyl or an alkyl group, especially a tertiary alkyl group, e.g. a t-butyl group;

$R^2$ is the main ballast group as described above;

$R^3$ is the secondary ballast group as described above; and $R^4$ is hydrogen or one or more halogen, alkyl or alkoxy groups.

Preferred cyan couplers useful in this first embodiment have the formulae:

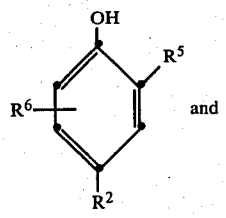

III and

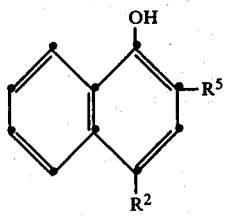

IV wherein:

$R^2$ is as defined above, one of of $R^5$ and $R^6$ is the secondary ballast group as described above and the other is hydrogen or one or more halogen, alkyl, alkoxy or alkylamido groups.

In particularly preferred couplers of this type, $R^2$ is:

$$-O-\underset{\underset{R^7}{|}}{CH}(CH_2)_mCH_3$$

$R^7$ is a solubilizing group, e.g. —COOH, —OH or $-SO_2NH_2$;

m is 5 to 20 and $R^5$ is $-CONHR^8$ in which $R^8$ is alkyl of 6 to 14 carbon atoms.

Preferred magenta couplers useful in this first embodiment can be represented by the formulae:

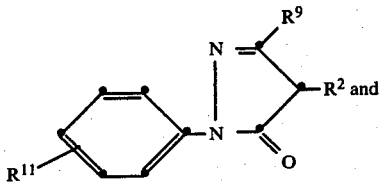

V and

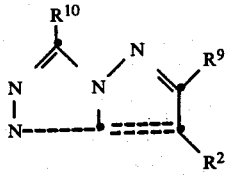

VI wherein:

$R^2$ is as defined above;

one of $R^9$ and $R^{10}$ is the secondary ballast group, as described above, and the other is hydrogen or an alkyl, alkoxy, aryl or amino group; and $R^{11}$ is hydrogen or one or more halogen, alkyl, alkoxy, or amino groups.

Unless otherwise indicated above, the alkyl, alkoxy and alkylamido substituents contain 1 to 8 carbon atoms; the aryl substituents contain 6 to 10 carbon atoms and the amino substituents include primary, secondary and tertiary amino groups. These substituents, as well as the primary and secondary ballast groups, can be further substituted with such groups as halogen, hydroxy, carboxy, amino, amido, carbamoyl, sulfamoyl, sulfonamido, alkyl, alkoxy and aryl. In all cases the substituents are selected so that the dye formed upon coupling has the desired slight mobility.

Couplers employed in the second embodiment can be represented by the structure:

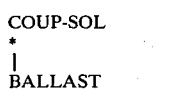

VII wherein:

COUP is a dye-forming coupler moiety, the asterisk (*) denoting the coupling position thereof;

BALLAST is a group, attached to the coupling position of COUP and detachable therefrom by means of reaction of COUP with oxidized color developing agent, which is of such size and configuration as to render the coupler nondiffusible; and SOL is a solubilizing substituent, attached to a noncoupling position of COUP, which renders the dye formed by coupling of COUP with oxidized color developing agent diffusible in the alkaline environment present during photographic processing.

The coupler moiety represented by COUP is the same as defined above in connection with the couplers useful in the first embodiment. Similarly, the ballast group represented by BALLAST is the same as the MAIN BALLAST described above.

The solubilizing substituent represented by SOL is or contains an ionizable group which confers on the dye formed by coupling the desired diffusibility, such as ionizable hydroxy, carboxylic acid, sulfonic acid, and aminosulfonyl groups and ionizable salts thereof. One or more of these groups can be attached directly to the coupler moiety or the SOL substituent can include an alkyl or aryl group of moderate size, e.g., 1 to 10 carbon atoms in the case of alkyl and 6 to 12 carbon atoms in the case of aryl, to which one or more ionizable groups are joined. Such solubilizing substituents can contain linking groups through which they are joined to the coupler moiety, like the linking groups which join the secondary ballast to the coupler moiety.

Preferred yellow, cyan and magenta couplers for use in this second embodiment have the structures II through VI shown above with the exception that the secondary ballast group represented by $R^3$, $R^5$ or $R^6$, and $R^9$ or $R^{10}$ is replaced by a solubilizing substituent as defined above which can be represented as groups $R^{13}$, $R^{14}$, $R^{15}$, $R^{16}$, $R^{19}$ and $R^{20}$. Preferred solubilizing substituents are (1) a carboxylic acid group, a sulfonic acid group or an ionizable salt thereof attached directly to a noncoupling position of the coupler, (2) an alkyl group of 1 to 10 carbon atoms or an aryl group of 6 to 12 carbon atoms attached to a noncoupling position of the coupler and containing one or more carboxylic acid groups, sulfonic acid groups or ionizable salts thereof, and (3) groups as in (2) joined to the noncoupling position through an amido or carbamoyl group.

The alkyl and aryl groups which form a part of the solubilizing substituent can be further substituted with such groups as halogen, amino, amido, carbamoyl, sulfamoyl, sulfonamido, alkyl, alkoxy and aryl. In all cases, these further substituents are selected so that the dye formed upon coupling has the desired diffusibility.

It will be appreciated that the couplers employed in the first and second embodiments represent a continuum with regard to mobility or diffusibility, with couplers which yield slightly mobile dyes at one end and those which yield fully diffusible dyes at the other end. Thus, a given grouping of atoms may be a secondary ballast for some couplers and a solubilizing substituent for other couplers, depending upon the particular coupler moiety to which it is attached, the nature of other substituents on that coupler moiety, and the particular developing agent employed.

The couplers useful in this invention are, in general, known compounds and can be prepared by known techniques for preparing dye-forming couplers. Certain couplers useful in the second embodiment are described in U.S. Pat. No. 3,227,550 for use in color diffusion transfer materials. Certain of the cyan dye-forming couplers useful in the first embodiment are the subject of U.K. Patent Application No. 8029461 filed Sept. 11, 1980 and the preparation of a representative such coupler is shown in the examples which follow.

The nondiffusible couplers which form nondiffusible dyes that are employed in the present invention can be any known dye-forming coupler which yields a nondiffusible dye of the appropriate color. Such couplers are present in at least one of the silver halide emulsion layers and, as indicated above, can be present in the same layer as the coupler which provides controlled image smearing.

The color couplers used in the present materials can be incorporated therein in conventional amounts by known methods. A typical amount of total dye-forming coupler in each layer is from about 0.02 to 2 grams per square meter. The hydrophobic couplers can be incorporated in droplets of coupler solvent, as is well known. Further details regarding couplers, methods for their incorporation and additives of varying type with which they can be employed are described in *Research Disclosure,* Item 17643, December 1978. *Research Disclosure* is published by Industrial Opportunities Limited, Homewell, Havant Hampshire, PO9 1EF, United Kingdom.

The mordant used in the second embodiment can be any mordant which will immobilize the dye formed as a result of the coupling reaction. Preferred mordants are basic polymeric mordants, e.g. polymers of amino guanidine derivatives of vinyl methyl ketone such as described in U.S. Pat. No. 2,882,156, and basic polymeric mordants such as described in U.S. Pat. Nos. 3,625,394 and 3,709,690 and 3,898,088. Other useful mordants are described in U.S. Pat. No. 3,859,096 and pages 80–82 of the November 1976 edition of *Research Disclosure.*

It will be appreciated that the further the mordant is positioned away from the color coupler, the greater will be the degree of image smearing. Hence the minimum smearing will occur when the mordant is incorporated in the coupler-containing layer. Increased image smearing can be obtained by spacing the mordant layer away from the coupler layer, for example with an inert interlayer, e.g. of gelatin. The amount of mordant employed will preferably be in the range 0.1 to 5 $g/m^2$, more preferably 0.3 to 1.5 $g/m^2$.

The present photographic elements can be single color elements (including black and white elements) but are preferably multicolor elements comprising a blue sensitive or sensitized emulsion unit having associated therewith a yellow dye-forming color coupler, a green sensitized emulsion unit having associated therewith a magenta dye-forming color coupler and a red sensitized emulsion unit having associated therewith a cyan dye-forming color coupler. Each unit can be comprised of a single emulsion layer or of multiple emulsion layers sensitive to a given region of the visible spectrum. The layers of the element, including the layers of the emulsion units, can be arranged in various orders as is known in the art. The coupler which forms the dye of increased mobility can be associated with only one or more of the above emulsion layers. It might be advantageous, for example, to have this coupler associated with a blue sensitive layer as the human eye is not so sensitive to sharpness in yellow images.

When the present multilayer materials contain multiple blue, green and red emulsion layers, there can be relatively faster and relatively slower emulsion layers in each case. Such materials are well known and are described, for example, in British Specification No. 1,500,497. In such cases it is preferred to have the coupler which forms a dye of increase mobility associated with one or more of the faster layers.

In the following discussion of suitable materials for use in the elements of this invention, reference will be made to *Research Disclosure,* December 1978, Item 17643, published by Industrial Opportunities Limited, Homewell, Havant, Hampshire, PO9 1EF, United Kingdom, the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers of this invention, the elements of the invention can include additional couplers as described in Research Disclosure Section VII, paragraphs D, E, F and G and the publications cited therein. These couplers and the couplers of this invention can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizer (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-N,N-diethyl-aniline hydrochloride, 4-amino-3-methyl-N-ethyl-N-β-(methanesulfonamido) ethyl-aniline sulfate hydrate, 4-amino-3-methyl-Nethyl-N-β-hydroxyethylaniline sulfate, 4-amino-3-β-(methanesulfonamido)ethyl-N,N-diethyl-aniline hydrochloride and 4-amino-N-ethyl-N(2-methoxyethyl)-m-toluidine di-p-toluene sulfonic acid.

With negative working silver halide this processing step leads to a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The term "nondiffusible" used herein has the meaning commonly applied to the term in photography and denotes materials that for all practical purposes do not migrate nor wander through organic colloid layers such as gelatin in an alkaline medium in the photographic elements of the invention and preferably when processed in a medium having a pH of 10 or greater. The term "diffusible" has the converse meaning and denotes materials having the property of diffusing effectively through the colloid layers of the photographic elements in an alkaline medium. The term "mobility" refers to the ability to diffuse.

The term "associated with" means that the two materials concerned are intended to interact during processing; they are contained in the same or adjacent layers.

The following examples are included for a better understanding of the invention. Experimental results are shown in FIGS. 1–8 of the accompanying drawings.

PREPARATIVE EXAMPLE 1

Preparation of a Coupler Which Yields a Slightly Mobile Cyan Dye

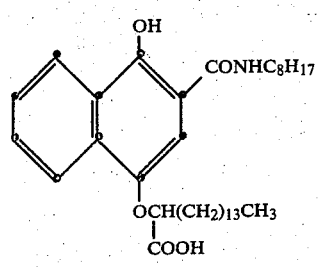

1(a) Ethyl-2-bromohexadecanoate (A)

2-Bromohexadecanoic acid (10 g. 30 mmole) was heated under reflux with ethanol (2.4 g 52 mmole) and benzene (10 ml). The apparatus was equipped with a Dean Stark trap for collecting the aqueous ethanol azeotrope. A trace of concentrated sulfuric acid was required to catalyze the esterification. After about 2 hours no more aqueous ethanol was being removed in the reaction.

After cooling, ethyl acetate (50 ml) was added and the solution extracted several times with 2% sodium hydrogen carbonate ($NaHCO_3$) solution containing a little sodium chloride. After washing with brine the organic phase was dried with magnesium sulfate and evaporated to yield a very pale yellow oil. This solidifies in the refigerator, the melting point being around 20° C. No distillation is required for purification.

Yield: 10 g. 93% $C_{18}H_{35}BrO_2$. Requires: C 59.50%; H 9.64%; Br 22.04%. Found: C 59.48%; H 9.53%; Br 21.97%.

1(b) Coupler (B)

1,4-Dihydroxy-2-naphthoic acid (5.3 g, 26 mmole) was dissolved in dry degassed dimethylsulphoxide (100 ml) and 50% sodium hydride oil dispersion (2.6 g 52 mmole) added with stirring under nitrogen at room temperature. The mixture was stirred and heated at 70°-80° C. under nitrogen until effervescence ceased. After cooling to room temperature the bromoester (A) (9.5 g 26 mmole) was added together with dry dimethylformamide (40 ml). After 1 hour the mixture was poured into dilute hydrochloric acid and the crude product filtered, washed with water and dried. Recrystallization was effected from ligroin.

Yield: 9.2 g 73% $C_{29}H_{42}O_6$. Requires: C 71.60%; H 8.64%. Found: C 71.15%; H 8.54%.

1(c) Acid Chloride (C)

The naphthol (B) (8.7 g 18 mmole) was converted to the acid chloride (C) by stirring with thionyl chloride (50 ml) and tetrahydrofuran (20 ml) at room temperature for 2 hours. The volatiles were removed in vacuo at 35°-40° C. yielding the acid chloride as a yellow/-green solid. No purification is necessary.

Yield: quantitative

1(d) Coupler (D)

The acid chloride (C) was dissolved in dry ethyl acetate (100 ml) and the solution added portionwise to a stirred solution of octylamine (4.7 g 36 mmole) in dry ethyl acetate (50 ml) at room temperature. After stirring for 2 hours, the amine hydrochloride was removed by filtration and the filtrate evaporated to yield an oil which soon crystallized. Recrystallization was effected in acetic acid containing a few drops of water.

Yield: 8.5 g (79%) $C_{37}H_{59}NO_5 \cdot \frac{1}{2}H_2O$. Requires: C 73.27%; H 9.90%; N 2.31%. Found: C 73.02%; H 9.67%; N 2.21%.

1(e) Product Coupler

Coupler (D) (6.0 g 10 mmole) was dissolved in dimethylformamide (80 ml) under nitrogen at room temperature. To this was added aqueous 10% sodium hydroxide (15 ml). After complete hydrolysis (30 minutes), the reaction mixture was poured into iced diluted hydrochloric acid (1 liter). The product was removed by filtration, washed with water and dried.

Recrystallization was effected from acetic acid.

Yield: 3.0 g (53%) $C_{35}H_{55}NO_5$. Required: C 73.81%; H 9.67%; N 2.46%. Found: C 73.54%; H 9.81%; N 2.15%.

EXAMPLE 1

A multilayer color negative material (Coating A) containing blue-, green and red-sensitive color forming units, each comprising a relatively fast and a relatively slow layer, was prepared having the structure set out below (pertinent coating weights in g/m$^2$). The color couplers in this and subsequent examples were incorporated in the silver halide emulsion by means of a coupler solvent.

| | |
|---|---|
| Mordant layer | |
| GELATIN | 1.81 |
| MORDANT 3 | 1.00 |
| Gelatin overcoat | |
| UV absorbing layer | |
| Relative fast, blue-sensitive emulsion layer | |
| SILVER HALIDE | 1.56 |
| GELATIN | 1.81 |
| COUPLER 2 | 0.17 |
| Relative slow, blue-sensitive emulsion layer | |
| Yellow filter layer | |
| Green and red-sensitive emulsion layers | |
| Cellulose acetate film base | |

A second control coating (Coating B) was made identical to Coating A except that Coupler 2 was replaced by an equimolar amount of Coupler 1 (0.24 g/m$^2$) and the mordant layer was omitted. Coupler 2 yields a diffusible image dye whereas Coupler 1 and all the other couplers of both coatings yield a nondiffusible image dye.

The couplers and mordant were as follows:

Coupler 1

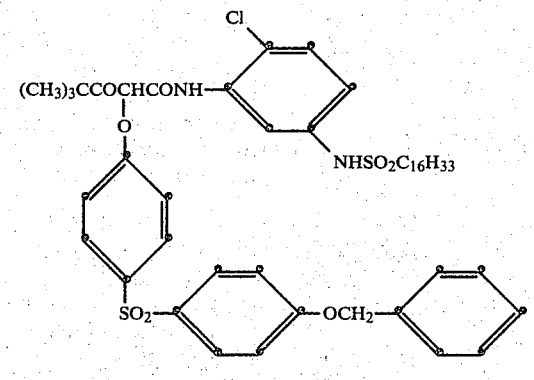

-continued

Coupler 2

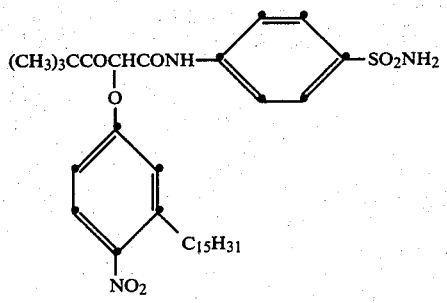

Mordant 3

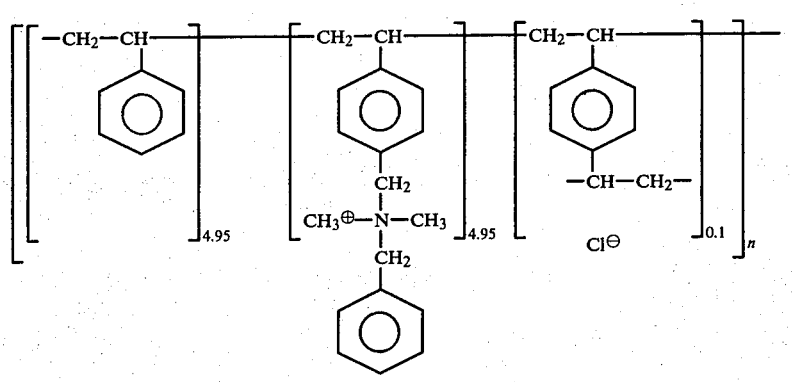

Figure 2:
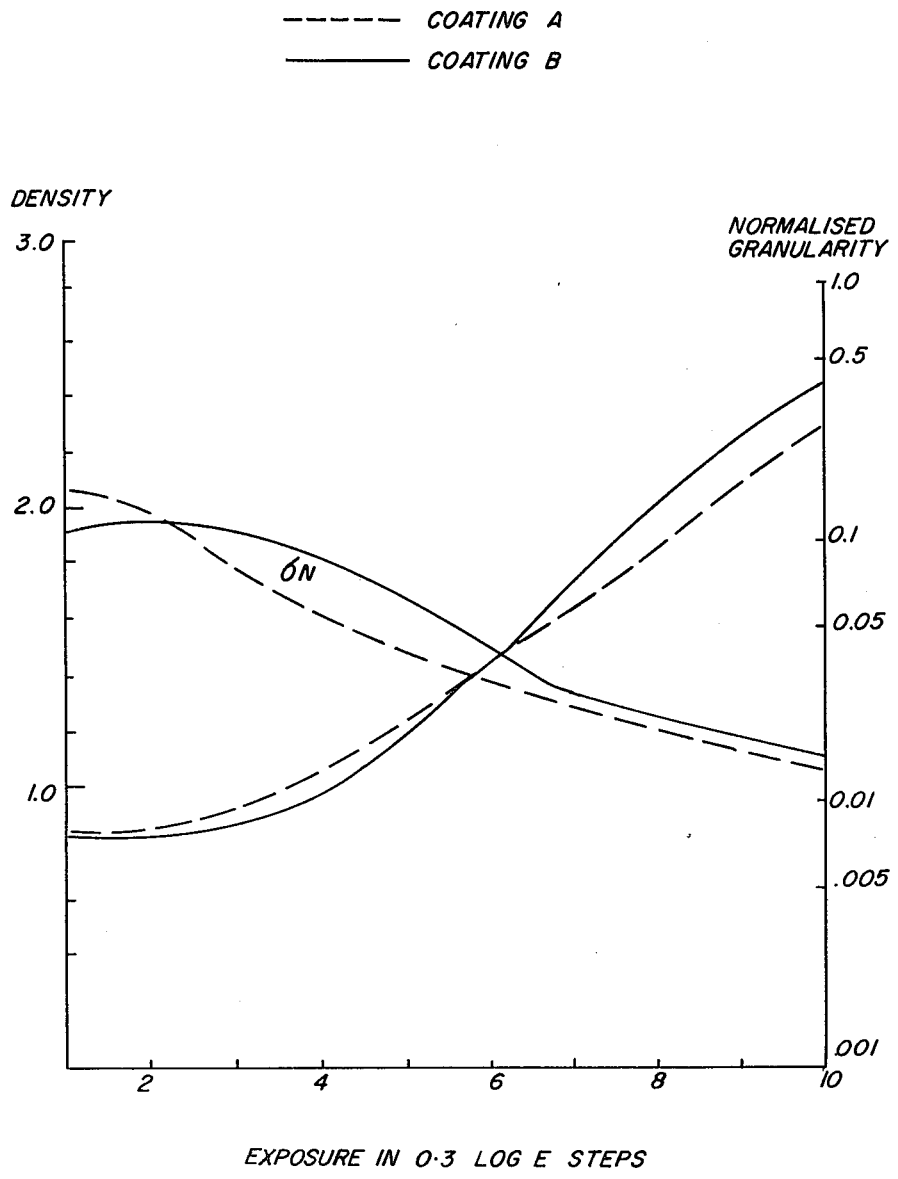

Portions of the two coatings were given identical sensitometric stepped exposures and processed together through the negative color process (C 41) described in the British Journal of Photography Annual 1977, pp. 204–5. The yellow densities of each sample were read and the RMS granularity determining by the method described in the *Theory of the Photographic Process,* 4th Edition, Edited by T. H. James, p. 619, using a scanning aperture of 48 microns. The density versus exposure curves obtained for Coatings A and B are shown in FIGS. 1 and 2. The red and green responses which are substantially the same in both cases are omitted for the sake of clarity. Coating A shows slightly more speed than Coating B in the lower scale of the blue record this being the normal region for assessing speed. The lower contrast of Coating A in the upper scale is due to the effect of the mordant layer on developability of the coating.

Also included in FIGS. 1 and 2 are granularity versus density measurements on the yellow images. FIG. 1 shows RMS Granularity ($\sigma$D) While FIG. 2 shows normalized granularity ($\sigma$N). Normalized granularity is obtained from RMS granularity by dividing by density, having first subtracted the contribution to this density from any colored masking couplers in the film. It is a useful parameter for purposes of comparison in that the effect of different sensitometry between coatings, which can itself influence granularity, is removed. The Figures show that Coating A exhibits greatly reduced granularity compared to Coating B, especially in the lower to mid scale region where color negative materials commonly show their highest granularities.

EXAMPLE 2

Multilayer coatings (Coatings C and D) were made identical to Coatings A and B except that:

(i) Coupler 1, which had been used in the slow blue sensitive, yellow forming, emulsion layer of Coatings A and B, was replaced by Compound 4 which is a ballasted hydroquinone; this forms a colorless compound hence, no dye is formed upon reaction with oxidized p-phenylenediamine developer. The yellow image from the Coatings C and D therefore originated exclusively from the fast, blue sensitive emulsion layer in each case.

(ii) To compensate for insufficient maximum dye density contribution from the fast layer in the coating containing an equimolar amount of Coupler 2, the level of this coupler was increased by 30%. This figure was derived from the results, not shown here, of previous calibration coatings. Compound 4 has the formula:

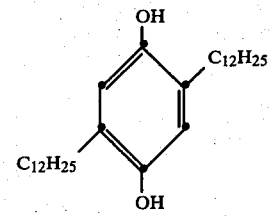

Figure 3:
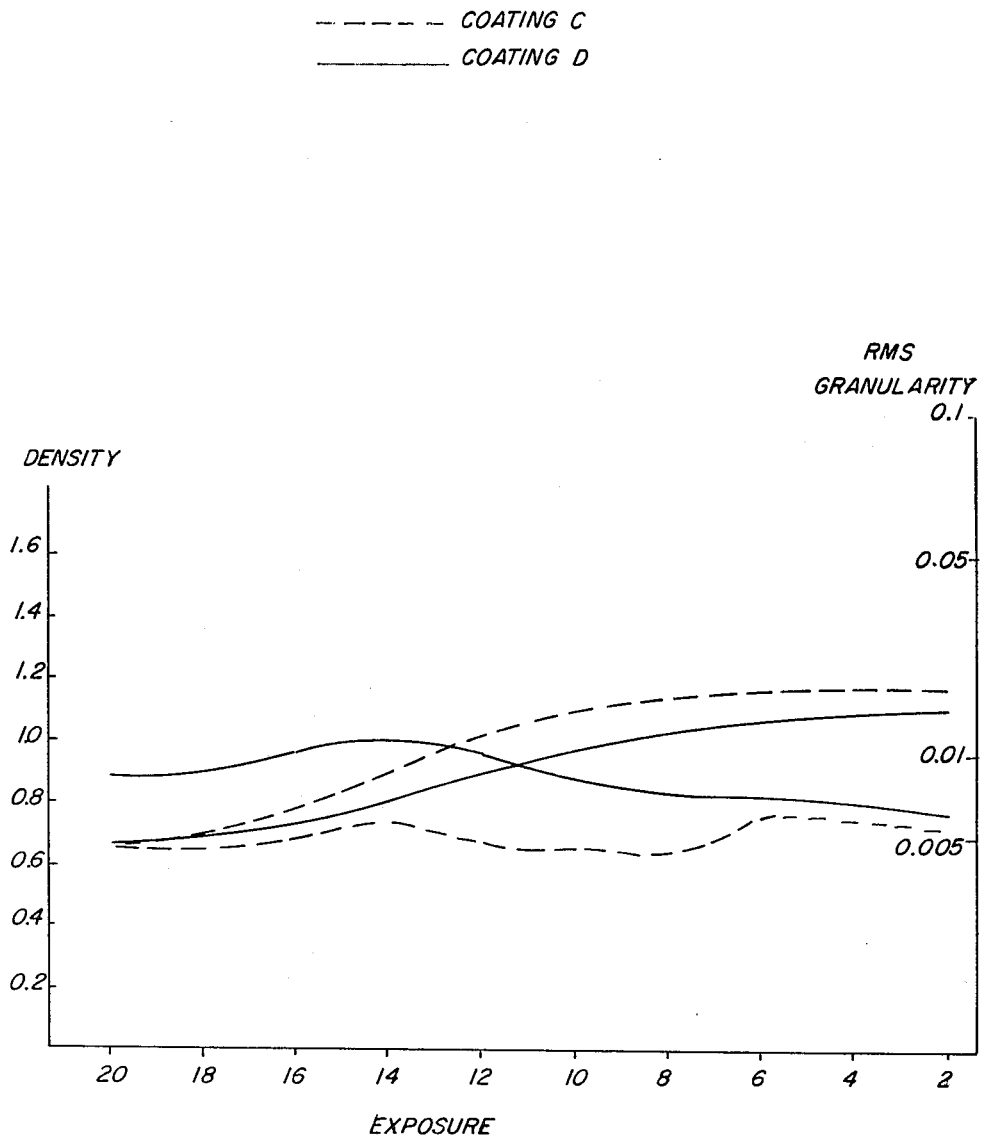
Figure 4:
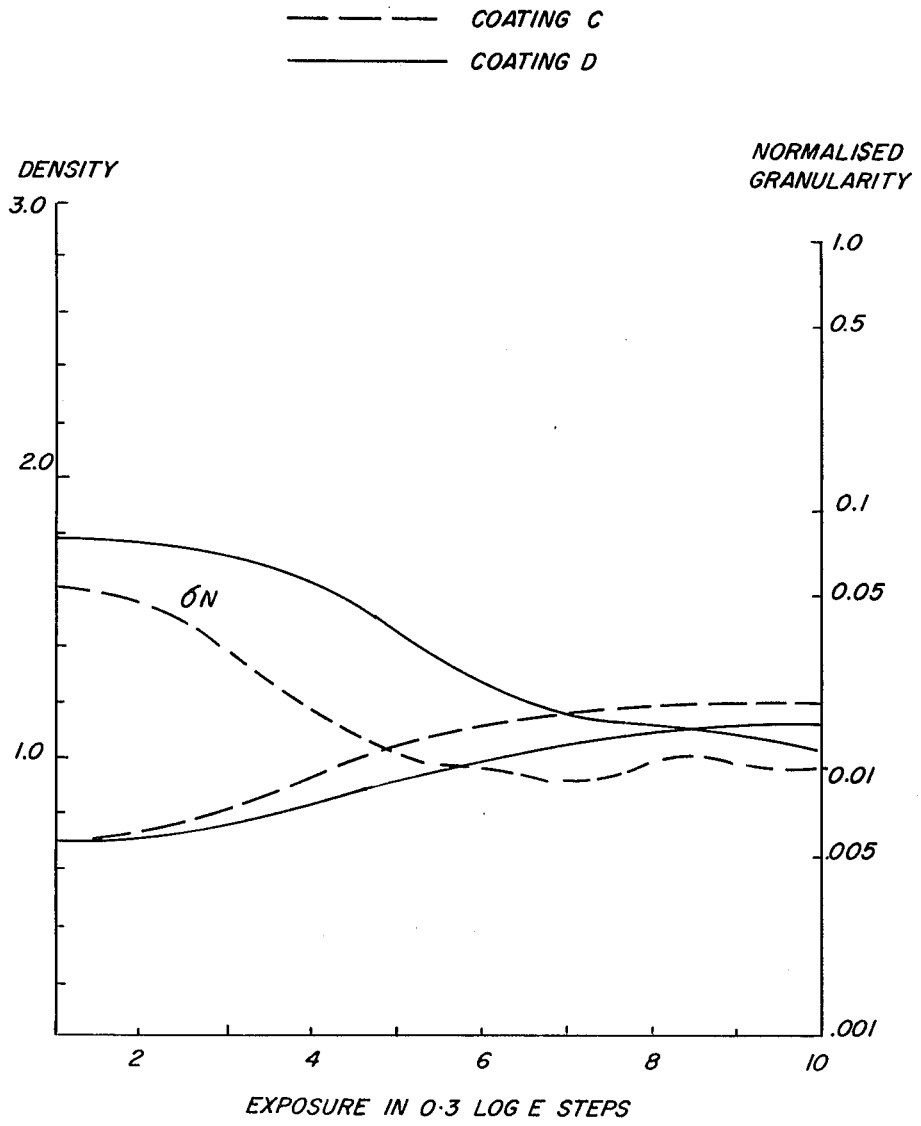

The coatings were exposed and processed as in Example 1. FIGS. 3 and 4 show the sensitometry resulting from imaging in the fast yellow layer only of Coatings C and D. The superior yellow sensitometry obtained from Coupler 2 is evident. Also shown in FIGS. 3 and 4 are the granularity results, which reveal that the reduction in $\sigma$D and $\sigma$N between Coatings C and D is at least as great as that between Coatings A and B.

EXAMPLE 3

A control multilayer color negative material (Coating E) containing blue-, green- and red-sensitive color forming units each comprising a relatively fast and a relatively slow emulsion layer was prepared having the following structure in which perinent coating weights are in g/m$^2$;

| Coating E | |
|---|---|
| Gelatin supercoat | |
| UV-absorbing layer | |
| Fast blue-sensitive emulsion layer | |
| Slow blue-sensitive emulsion layer | |
| Yellow filter layer | |
| Interlayer | |
| Fast green-sensitive emulsion layer | |
| Silver halide | 2.14 |
| Gelatin | 2.20 |
| Coupler 5 | 0.35 |
| Interlayer | |
| Fast red-sensitive emulsion layer | |
| Interlayer | |
| Slow green-sensitive emulsion layer | |
| Interlayer | |
| Slow red-sensitive emulsion layer | |
| Antihalation layer | |
| Cellulose acetate film base | |

Coatings F, G and H were the same as Coating E except that they had a mordant layer coated over the gelatin supercoat containing Mordant 3 at 0.5 g/m$^2$ and gelatin at 2 g/m$^2$ and that Coupler 5 which forms a nondiffusible dye was progressively replaced with equivalent amounts (equal maximum dye density) of Coupler 6 which forms a diffusible dye as detailed below.

The couplers had the following formulae:

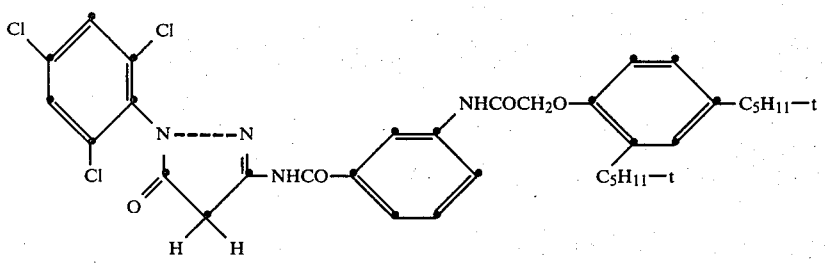

Coupler 5

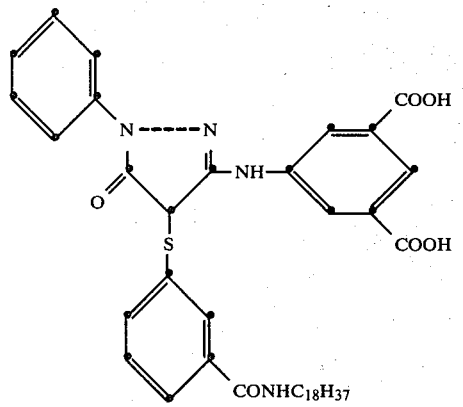

Coupler 6

The fast green-sensitive layers of Coatings F–H were as follows:

| | | |
|---|---|---|
| Coating F | Silver halide | 2.14 |
| | Gelatin | 2.20 |
| | Coupler 5 | 0.26 |
| | Coupler 6 | 0.13 |
| Coating G | Silver halide | 2.14 |
| | Gelatin | 2.20 |
| | Coupler 5 | 0.17 |
| | Coupler 6 | 0.25 |
| Coating H | Silver halide | 2.14 |
| | Gelatin | 2.20 |
| | Coupler 6 | 0.51 |

Figure 5:
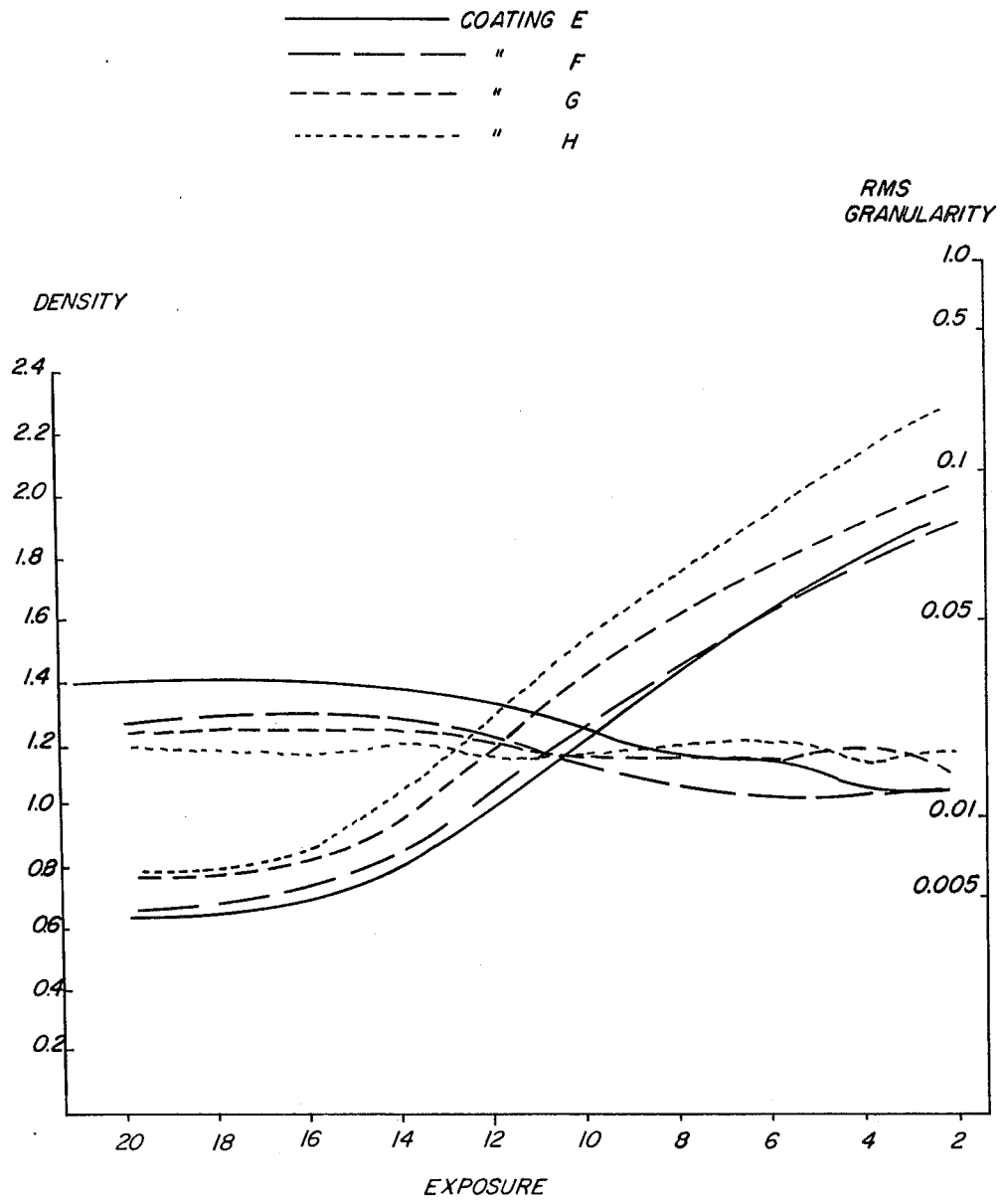
Figure 6:
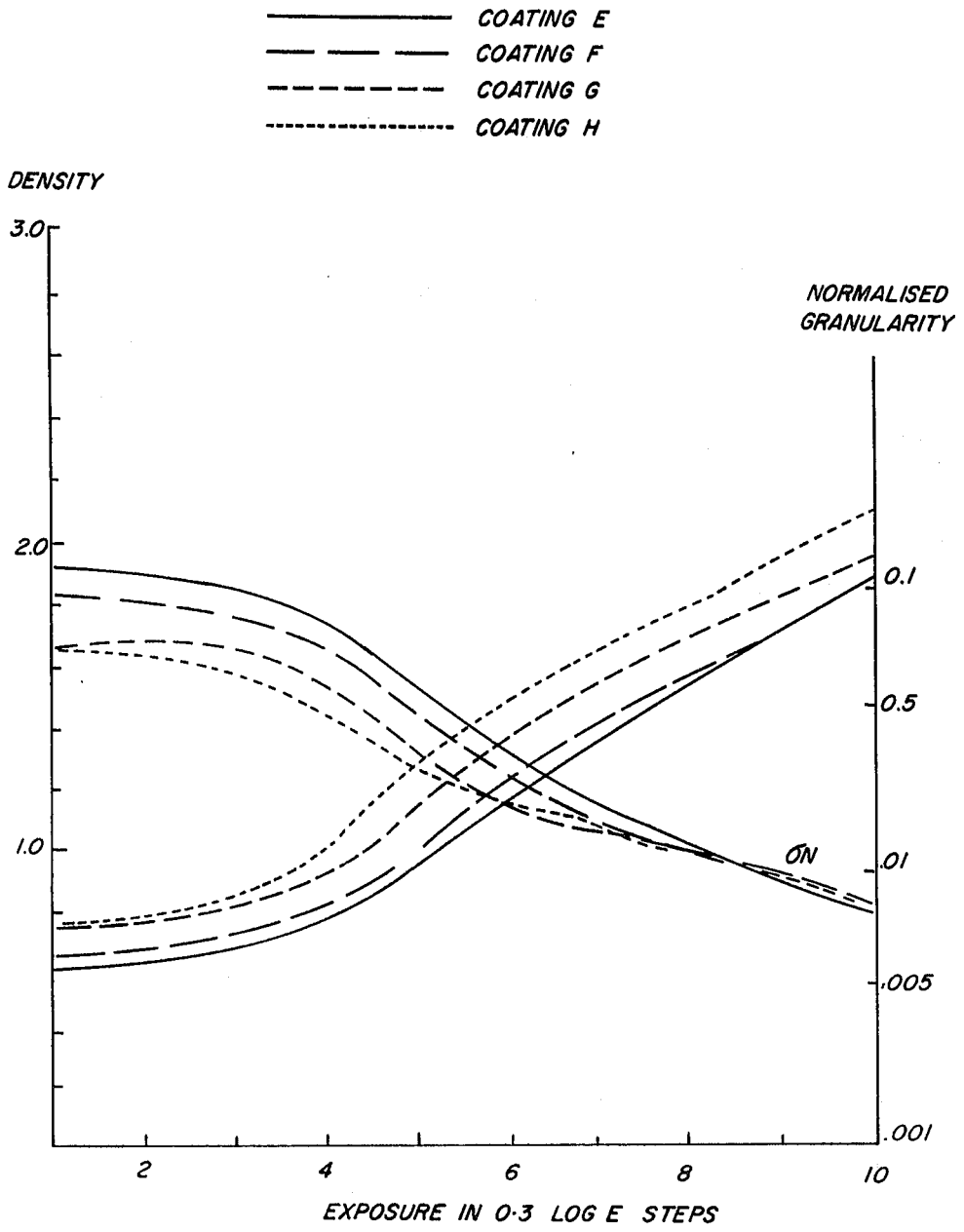

Samples of the above coatings were exposed and processed as described in Example 1 and plots of green density and granularity are shown in FIGS. 5 and 6 of the accompanying drawings.

The red and blue sensitometry and granularity data, which are unchanged throughout all these coatings, are omitted for the sake of clarity. Despite the higher fog and contrast introduced by Coupler 6 in Coatings F, G and H, the normalized granularity in which the effects of the differing sensitometry are removed, shows a progressive decrease as the proportion of Coupler 6 increases. Coating H therefore exhibits a greatly reduced granularity compared to Coating E.

Thin cross-sections cut from the processed films showed that the fast magenta image dye in Coating E remained in the layer in which Coupler 5 was coated. However, the image in Coating F appeared in both the fast magenta layer and in the mordant layer. An increased amount of dye appeared in the mordant layer for Coating G, and finally for Coating H all the dye was in the mordant layer and none in the fast magenta layer where Coupler 6 was coated. The image dye formed by Coupler 6 is therefore capable of complete migration to a remote mordant layer, and enables the observed reduction in granularity by dye smearing to be achieved.

EXAMPLE 4

Color negative materials were prepared having the coating structure described below. Pertinent coating weights are given in g/m$^2$.

| | |
|---|---|
| Gelatin | 0.888 |
| Sensitized silver halide | 1.5 (as silver) |
| Gelatin | 3.0 |

-continued

| | |
|---|---|
| Hardener | 2% of total gelatin |
| Coupler* | |
| Coupler solvent** | |
| Support | |

*Coupler lay-down is calculated such that [Ag:Coupler] molar ratio is [16:1].
**The Coupler solvent was tricresyl phosphate. Coupler to coupler solvent weight ratio was 1:1.

Coupler 7

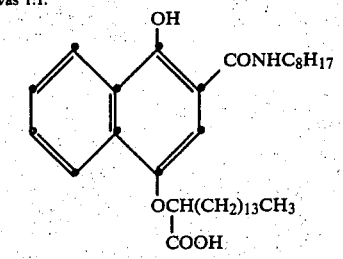

Coupler X

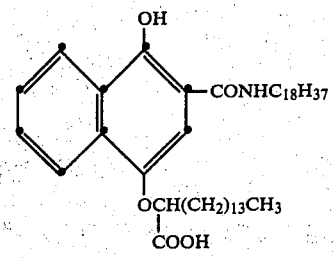

Coupler Y

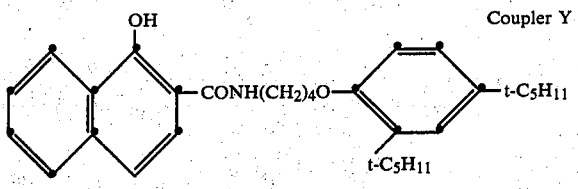

The prepared coatings were exposed and processed as in Example 1. The cyan densities of each coating were read and the RMS granularity estimated as in Example 1. The sensitometric data obtained are listed in the Table below.

TABLE

| Coupler | $D_{min}$ | $D_{max}$ | Contrast | Speed |
|---|---|---|---|---|
| 7 | 0.20 | 1.46 | 1.24 | 342 |
| X (Control) | 0.19 | 1.47 | 1.13 | 339 |
| Y (Control) | 0.10 | 1.20 | 0.66 | 332 |

Figure 7:
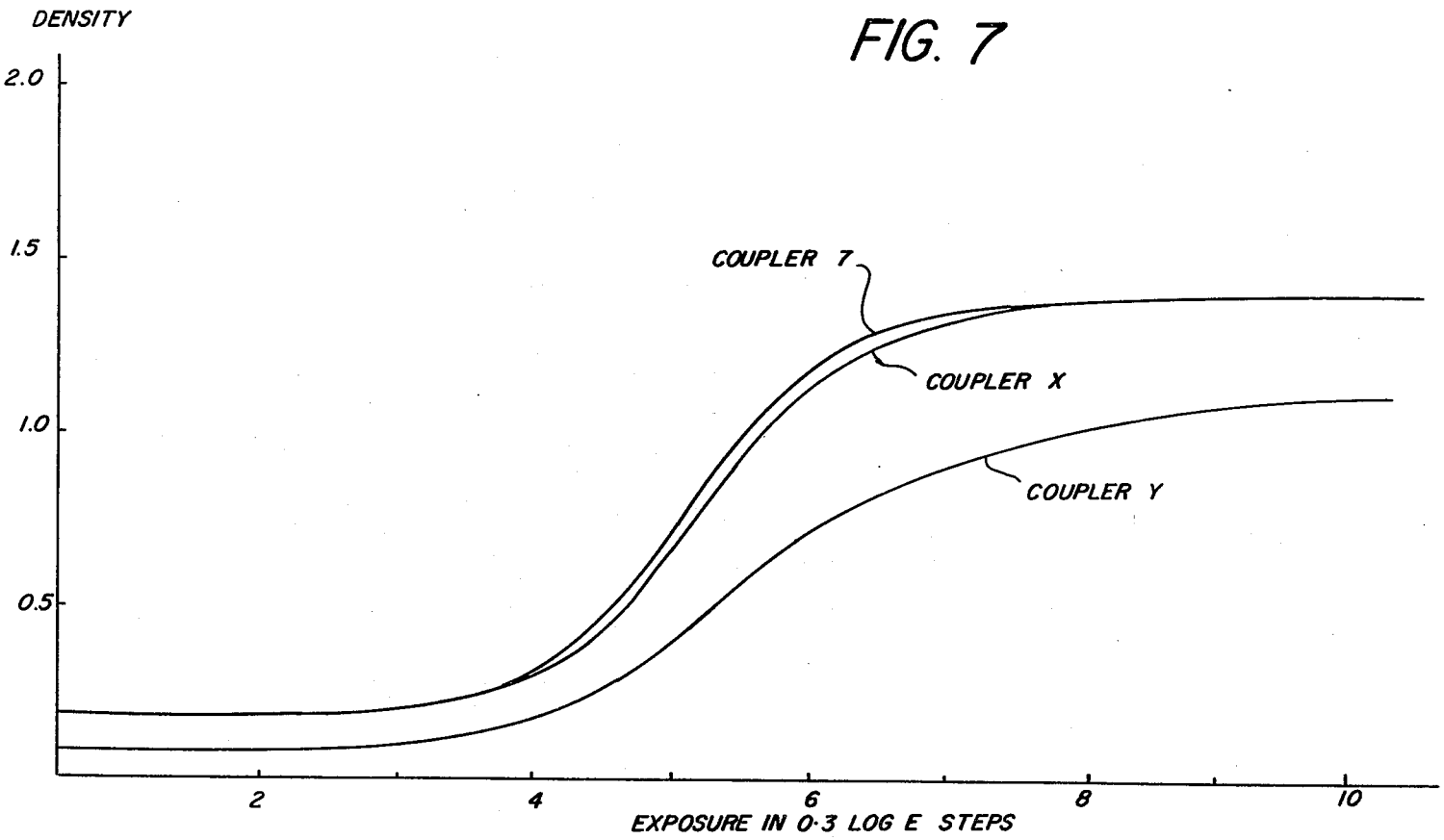
Figure 8:
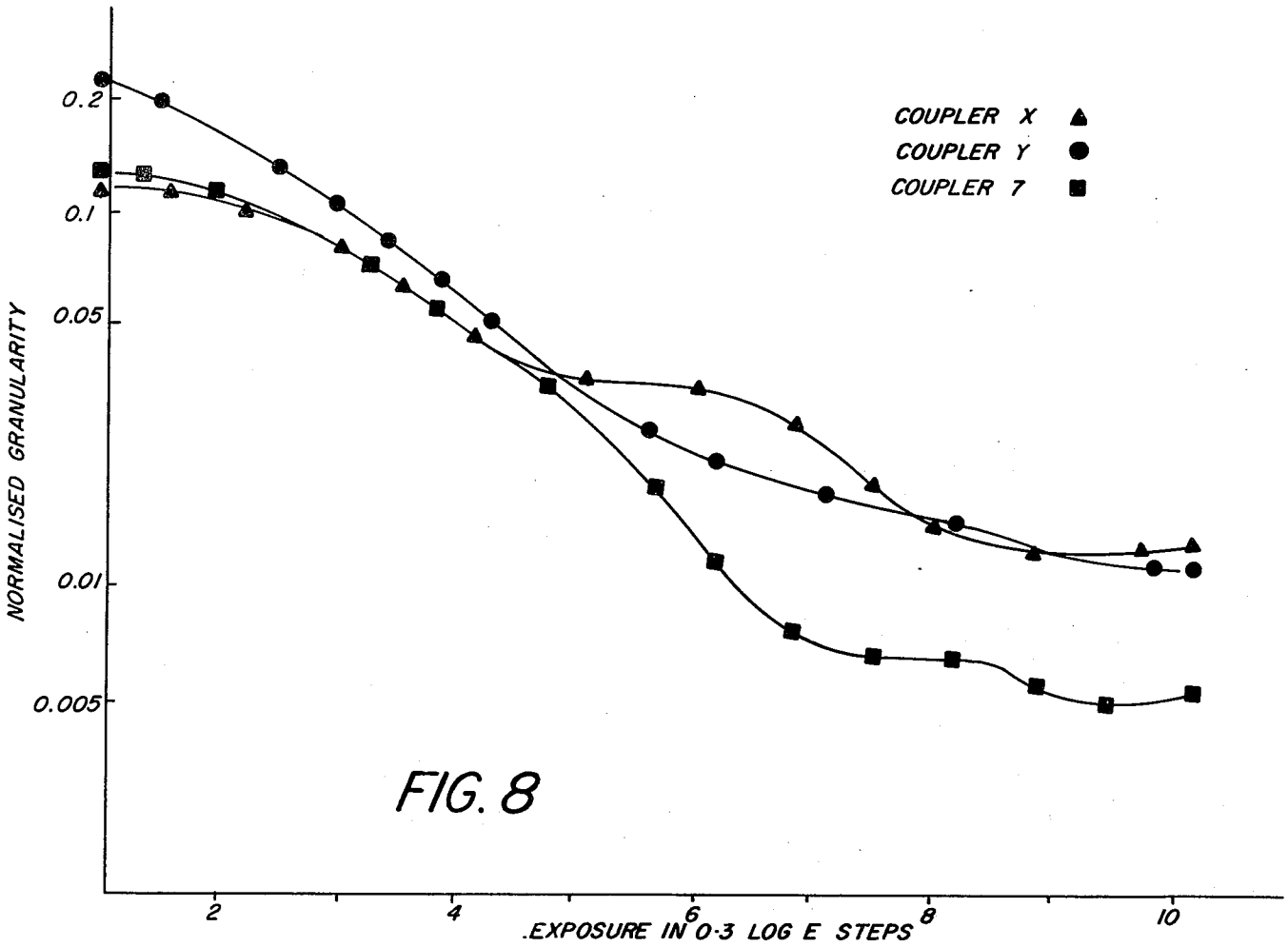

The characteristic curves obtained are shown in FIG. 7 and a plot of normalized granularity vs. density is shown in FIG. 8 of the accompanying drawings.

From the results it can be seen that compared with Coupler Y, Coupler 7 shows markedly reduced normalized granularities over the whole density range whereas Coupler X shows a granularity improvement only at low densities.

The invention has been described in detail with particular reference to certain preferred embodiments thereof, but it will be understood that variations and modifications can be effected within the spirit and scope of the invention.

What is claimed is:

1. A silver halide photographic element comprising at least one silver halide emulsion layer and nondiffusible dye-forming couplers associated with the layer or layers wherein the nondiffusible dye-forming couplers comprise a first nondiffusible dye-forming coupler which, upon reaction with oxidized color developing agent, yields a nondiffusible first dye and a second, different, nondiffusible dye-forming coupler which, upon reaction with oxidized color developing agent, yields a second dye of such mobility that said second dye in combination with said first dye produces controlled image smearing in said photographic element, said second coupler yielding a dye of limited mobility and having the structure:

COUP—SECONDARY BALLAST
*
|
MAIN BALLAST wherein:

COUP is a dye-forming coupler moiety, the asterisk (*) denoting the coupling position thereof;

MAIN BALLAST is a group, attached to the coupling position of COUP and detachable therefrom by means of reaction of COUP with oxidized color developing agent, which is of such size and configuration as to render the coupler nondiffusible; and SECONDARY BALLAST is a group, attached to a noncoupling position of COUP, which is of such size and configuration that the dye formed by coupling of COUP with oxidized color developing agent is slightly mobile.

2. A silver halide photographic element comprising at least one silver halide emulsion layer and nondiffusible dye-forming couplers associated with the layer or layers wherein the nondiffusible dye-forming couplers comprise a first nondiffusible dye-forming coupler which, upon reaction with oxidized color developing agent, yields a nondiffusible first dye and a second, different, nondiffusible dye-forming coupler which, upon reaction with oxidized color developing agent, yields a second dye of such mobility that said second dye in combination with said first dye produces controlled image smearing in said photographic element, said second coupler yielding a diffusible dye and having the structure:

COUP—SOL
*
|
BALLAST

COUP is a dye-forming coupler moiety, the asterisk (*) denoting the coupling position thereof;

BALLAST is a group, attached to the coupling position of COUP and detachable therefrom by means of reaction of COUP with oxidized color developing agent, which is of such size and configuration as to render the coupler nondiffusible; and SOL is a solubilizing substituent, attached to a noncoupling position of COUP, which renders the dye formed by coupling of COUP with oxidized color developing agent diffusible in the alkaline environment present during photographic processing and, associated with the layer containing the second coupler, a mordant which immobilizes the diffusible dye.

3. An element of claims 1 or 2 wherein the element comprises at least two silver halide emulsion layers, the first coupler being associated with at least one of the layers and the second coupler being associated with at least one other of the layers.

4. An element of claim 3 wherein each of the silver halide emulsion layers contains a coupler which yields a nondiffusible dye.

5. An element of claim 1 or 3 wherein said first and second couplers yield dyes which absorb in the same primary region of the visible spectrum.

6. An element of claims 1 or 2 wherein one of said first and second couplers yields a dye which absorbs in one primary region of the visible spectrum and the other of said first and second couplers yields a dye which absorbs in a different primary region of the visible spectrum.

7. An element of claim 1 wherein

COUP is an acylacetanilide, pyrazolone, pyrazolotriazole, phenol or naphthol coupler moiety;

MAIN BALLAST is an alkyl or aryl group of 8 to 32 carbon atoms joined to the coupling position of COUP through a linking group; and SECONDARY BALLAST is an alkyl group of 2 to 20 carbon atoms or an aryl group of 6 to 20 carbon atoms.

8. An element of claim 1 wherein the second coupler has one of the structures:

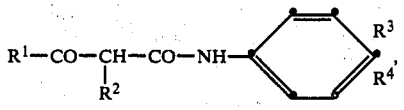

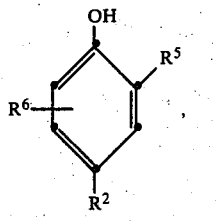

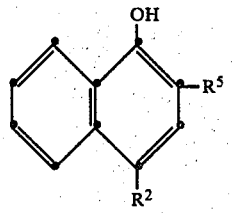

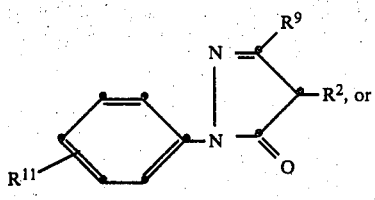

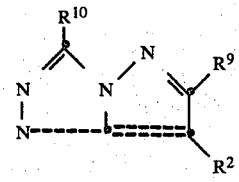

wherein:

$R^1$ is an aryl group or an alkyl group;

$R^2$ is the main ballast group;

$R^3$ is the secondary ballast group;

$R^4$ is hydrogen or one or more halogen, alkyl or alkoxy groups;

one of $R^5$ and $R^6$ is the secondary ballast group and the other is hydrogen or one or more halogen, alkyl alkoxy or alkylamido groups;

one of $R^9$ and $R^{10}$ is the secondary ballast group and the other is hydrogen or an alkyl, alkoxy, aryl or amino group; and $R^{11}$ is hydrogen or more or more halogen, alkyl, alkoxy or amino groups.

9. An element of claim 2 wherein

COUP is an acylacetanilide, pyrazolone, pyrazolotriazole, phenol or naphthol coupler moiety;

BALLAST is an alkyl or aryl group of 8 to 32 carbon atoms joined to the coupling position of COUP through a linking group;

SOL is selected from:

(1) a carboxylic acid group, a sulfonic acid group or an ionizable salt thereof;

(2) an alkyl group of 1 to 10 carbon atoms or an aryl group of 6 to 20 carbon atoms attached directly to a non-coupling position of COUP and containing at least one carboxylic acid group, sulfonic acid group or ionizable salt thereof; and (3) an alkyl group of 1 to 10 carbon atoms or an aryl group of 6 to 20 carbon atoms attached to a noncoupling position of COUP through an amido group or a carbamoyl group and containing at least one carboxylic acid group, sulfonic acid group or ionizable salt thereof.

10. An element of claim 2 wherein the second coupler has one of the structures:

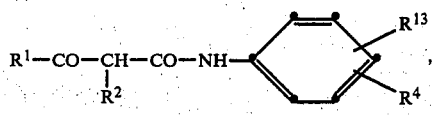

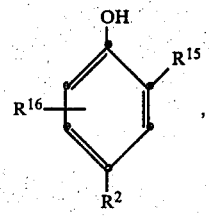

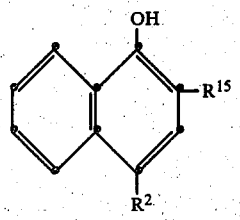

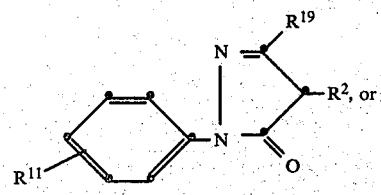

-continued

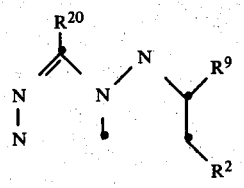

wherein:

$R^1$ is an aryl group or an alkyl group;

$R^2$ is the main ballast group;

$R^{13}$ is the solubilizing substituent;

$R^4$ is hydrogen or one or more halogen, alkyl or alkoxy groups;

one of $R^{15}$ and $R^{16}$ is the solubilizing substituent and the other is hydrogen or one or more halogen, alkyl alkoxy or alkylamido groups;

one of $R^{19}$ and $R^{20}$ is the solubilizing substituent and the other is hydrogen or an alkyl, alkoxy, aryl or amino group; and $R^{11}$ is hydrogen or more or more halogen, alkyl, alkoxy or amino groups.

11. An element of claim 2 wherein the mordant and the second coupler are in the same layer.

12. An element of claim 2 wherein the mordant and the second coupler are in contiguous layers.

13. An element of claim 2 wherein the mordant and the second coupler are separated by an intervening layer.

14. An element of claim 2 wherein the mordant is a basic polymeric mordant.

* * * * *